United States Patent [19]

Santa Lucia et al.

[11] 4,436,249

[45] Mar. 13, 1984

[54] WINDING SYSTEM

[75] Inventors: Jack Santa Lucia, N. Haledon; Kenneth Trapp, West New York, both of N.J.

[73] Assignee: Independent Maching Company, Paterson, N.J.

[21] Appl. No.: 344,807

[22] Filed: Feb. 1, 1982

[51] Int. Cl.[3] ..... B65H 54/02; B65H 54/40; B65H 54/54

[52] U.S. Cl. ..... 242/18 R; 242/35; 242/35.5 R; 242/46.4; 242/46.6; 74/198; 192/85 CA; 192/110 B

[58] Field of Search ..... 242/18 R, 25 R, 26, 242/35, 35.5 R, 45, 46.2, 46.3, 46.4, 46.6, 47; 192/66, 85 R, 85 A, 85 C, 85 CA, 110 R, 110 B; 74/198; 464/35, 36, 139, 178; 308/233

[56] References Cited

U.S. PATENT DOCUMENTS

| | | | |
|---|---|---|---|
| 1,454,660 | 5/1923 | Tuttle | 242/46.6 |
| 2,224,001 | 12/1940 | Newton et al. | 242/46.4 |
| 3,093,331 | 6/1963 | Carroll | 242/46.6 |
| 3,760,916 | 9/1973 | Hanks et al. | 192/85 CA X |
| 4,226,318 | 10/1980 | Morgan | 192/85 CA |

*Primary Examiner*—Stanley N. Gilreath
*Attorney, Agent, or Firm*—Mason, Fenwick & Lawrence

[57] ABSTRACT

A winding system includes a frame with a power driven shaft mounted on the frame and a work fluid source for providing work fluid at a selected variable pressure. A carrier block is mounted on the shaft with mandrel means being removably mounted on the carrier block for rotation therewith and including wound material support means for receiving material being wound. An annular piston and cylinder encircles the driven shaft and engages a drive disc rotation by the driven shaft having friction means on a surface engaging the carrier block so that the drive block is urged toward the carrier block with a force in proportion to the pressure of the work fluid to vary the winding tension provided by the mandrel.

3 Claims, 7 Drawing Figures

WINDING SYSTEM

BACKGROUND OF THE INVENTION

The present invention is in the field of winding and reeling apparatus and is more specifically directed to a new and improved winder in which the maximum amount of winding torque can be easily adjusted and which is versatile in being usable with different types of devices for receiving the package being wound.

It has been conventional practice in the past to provide a mandrel on which a spool or the like is mounted for driven rotation for receiving material to be wound. It is desirable that such devices not exceed a predetermined torque in order to avoid over-tensioning of the material being wound. Along these lines, slip-type drive connections employing a friction disc or the like urged by adjustable spring means into driving engagement with a driven means have been proposed such as in U.S. Pat. No. 4,157,793. However, when devices of the foregoing conventional type are employed in a winding apparatus having a large number of spindles, it is necessary that each and every spindle drive be adjusted in an effort to achieve a desired torque and tension in the material being wound. In practicality, it is essentially impossible to achieve precise uniformity with such mechanical devices. Moreover, the adjustments necessary when changing from one winding tension to another are inherently time consuming and burdensome and consequently increase the expense of the operation.

Yet another problem encountered in prior known winding and reeling devices is that many such devices are incapable of usage with a variety of different types of wound packages. For example, it is sometimes desirable to be able to wind material on a spool or bobbin while at other times it is desirable to be able to wind material on cardboard tubes or perforated dye tubes of metal or plastic. In many instances it is impossible to use the same winding apparatus for the winding of different types of package configurations.

Therefore, it is the primary object of this invention to provide a new and improved winding apparatus.

Another object of the present invention is the provision of new and improved winding apparatus in which the maximum winding tension can be easily and accurately adjusted.

Yet another object of the present invention is the provision of new and improved winding apparatus having the capability of usage with different types of winding material receiving devices.

SUMMARY OF THE INVENTION

Achievement of the foregoing objects is enabled by the preferred embodiment of the invention through the provision of a power driven shaft connected through a friction drive means to a driven mandrel carrier block which is coaxially positioned on the outer end of the shaft for rotation with respect to the shaft. An annular cylinder and piston assembly encircles the shaft and is supported on stationary frame means with an air hose being connected to the cylinder so that the introduction of air into the cylinder serves to move the piston in a direction axially outwardly with respect to the power driven shaft to urge a drive disc having friction material on one surface into driving contact with the driven mandrel carrier block. The drive disc is mounted for axial reciprocation on the shaft by means of a key and slot arrangement which permits rotation of the shaft to be conveyed to the drive disc while permitting the axial movement necessary for adjusting the force with which it is urged against the mandrel carrier block to vary the maximum torque exerted on the carrier block by the drive disc. It is consequently easy to adjust the torque exerted on the carrier block by simply adjusting the air pressure to the cylinder. Consequently, when a plurality of the driven shafts are used in a winding machine for driving a plurality of spindles, the maximum torque exerted on all of the spindles can be simultaneously easily adjusted.

Another feature of the invention resides in the fact that the forward face of the carrier block includes threaded openings by means of which various mandrel assemblies can easily be connected to the carrier block in accordance with the nature of the particular package to be wound. It is consequently a simple matter to change over from one type of package to another without any substantial mechanical adjustments or modifications being necessary.

A better understanding of the manner in which the preferred embodiment achieves the foregoing objects will be enabled when the following detailed description is considered in conjunction with the appended drawings in which like reference numerals are used for the same parts as illustrated in the different figures.

DESCRIPTION OF THE PREFERRED EMBODIMENT

Figure 2:
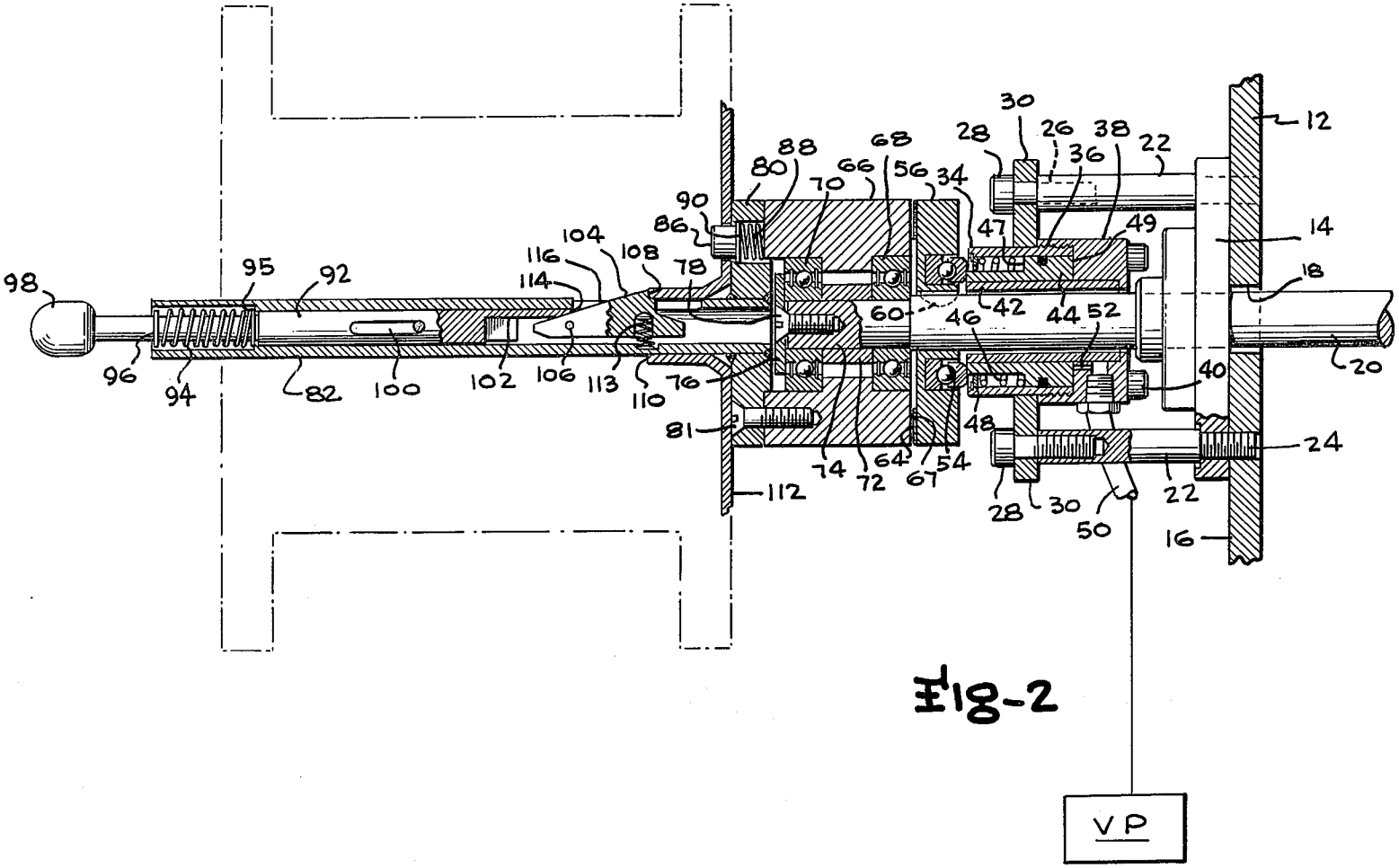
FIG. 2 is a sectional view taken along lines 2—2 of FIG. 1.

The first embodiment of the invention, generally designated 10, includes a supporting frame plate 12 of sufficient thickness and rigidity to provide firm and stable support for the remaining structure in a cantilever manner as best shown in FIG. 2. The supported structure includes a flanged bearing 14 mounted on outer surface 16 of the frame plate 12 and being coaxially aligned with an aperture 18 extending through the frame plate 12 and through which a drive shaft 20 extends. Threaded studs 22 have threaded end surfaces 24 secured in tapped bores in the frame plate 12 for maintaining the flange bearing 14 in position as best shown in FIG. 2. Additionally, axial threaded apertures 26 are provided in the outer ends of the threaded stud members 22 for receiving machine screws 28 mounting a cylinder carrier plate 30 on the ends of the stud members 22.

Carrier plate 30 is provided with a central aperture 32 for matingly receiving and supporting an outer cylinder sleeve 34 having a threaded connection 36 at one end with a head block 38 which is held in position on the carrier plate 30 by machine screws 40. Additionally, an inner cylinder sleeve 42 is fixedly connected to the head block 38 so that the outer surface of the inner cylindrical sleeve 42 cooperates with the inner surface of the outer cylinder sleeve 34 and the head block 38 to define an annular chamber in which an annular piston 44 is mounted. Spring means 46 engages a retainer clip 48 on the inner surface of outer cylindrical sleeve 34 on one end as shown in FIG. 2 and on an opposite end engages a radial shoulder of the annular piston 44 to urge annular piston 44 to the right in FIG. 2. An air hose 50 extending from a source VP of variable air pressure is connected to the head block 38 for providing pressurized air through a passageway 52 to the annular cylindrical space between cylinders 34 and 42 so that the compressed air acts on the head end surface of annular piston 44 to urge it to the left against the bias of spring means 46. It will consequently be seen that the introduction of compressed air from hose 50 will serve to shift the piston 44 to the left so that its outer end 44' (FIG. 3) engages rotary thrust bearing means 54 mounted on the inner surface of a drive disc 56 mounted for limited axial reciprocation on the drive shaft 20.

Drive disc 56 has a keyway 58 slidably fitted over a key 60 positioned in slot 62 in the drive shaft 20. Rotation of drive shaft 20 consequently serves to rotate the drive disc 56 which is capable of limited axial movement on the drive shaft 20 due to the key and slot drive connection 58, 60 between shaft 20 and drive disc 56. Conventional friction drive material 64 is provided on the outer face of the drive disc 56. A driven mandrel carrier block 66 is mounted for rotation on bearings 68 and 70 which are separated by a spacer sleeve 72 and supported on a reduced diameter end portion 74 of the drive shaft 20. Bearing means 68, 70 etc. is held in position on the drive shaft 20 by a retainer washer 76 and a machine screw 78 threaded into a tapped opening 77 extending inwardly axially of the outer end of the drive shaft.

Figure 3:
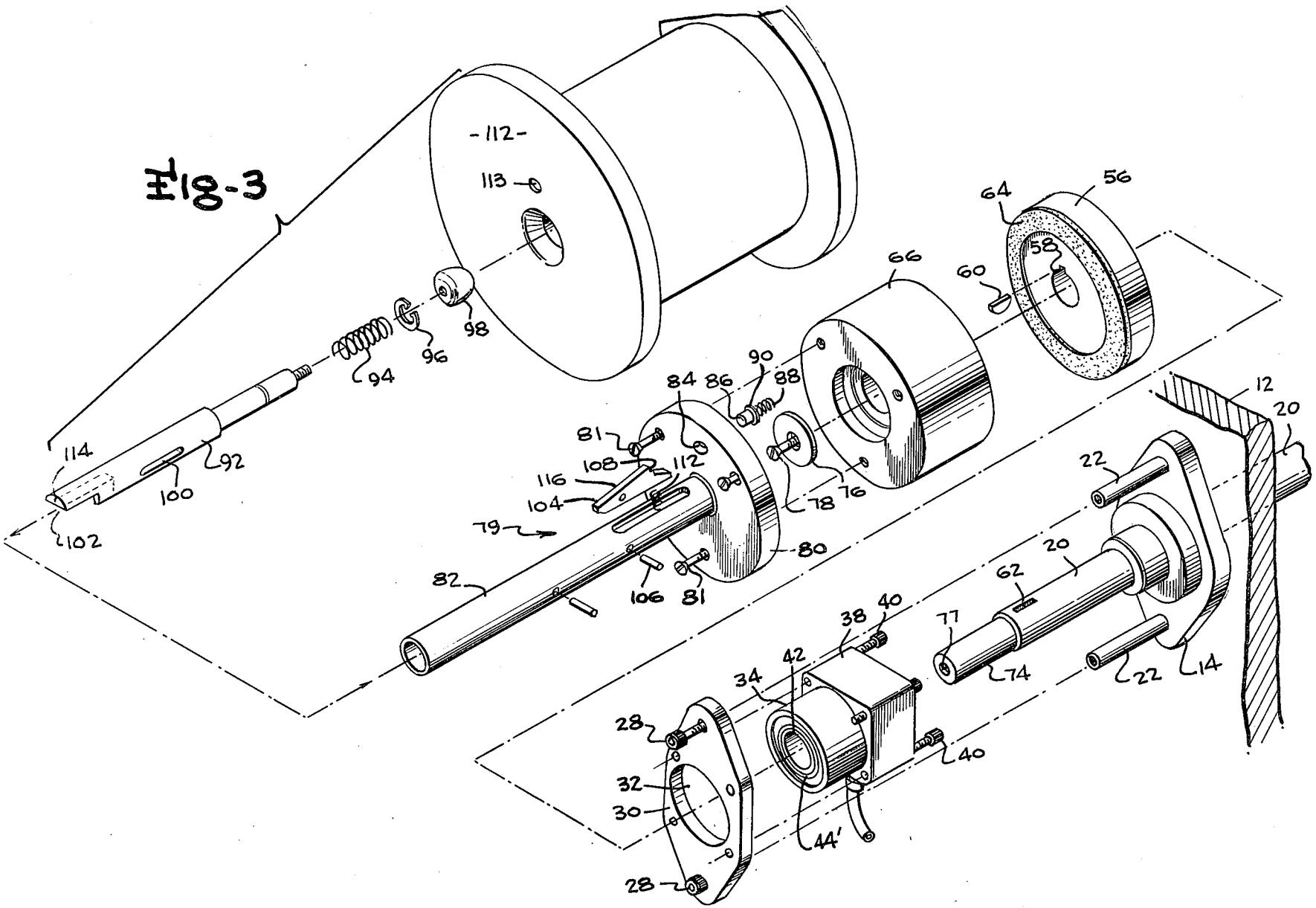
FIG. 3 is an exploded perspective view of the preferred embodiment.

Spindle support means generally designated 79 in FIG. 3 is attached to the driven carrier block 66 and includes a coupling disc 80 attached to carrier block 66 by machine screws 81 from the forward face of which a mandrel sleeve 82 extends. It will be observed from inspection of FIG. 2 that the mandrel sleeve 82 is welded to an axial opening within the coupling disc 80. Also, an opening 84 in the front face of the coupling disc supports a spring urged drive pin 86 which is urged into an extended position by spring means 88 as shown in FIG. 2. A flange 90 extends about the base of drive pin 86 and prevents the drive pin from moving outwardly through the opening 84 due to the fact that the flange 90 is of larger diameter than opening 84.

An ejector shaft 92 is coaxially mounted within mandrel sleeve 82 for axial reciprocation and is urged to the left by a compression spring 94 having an inner end engaging a radial shoulder 95 on the inner surface of mandrel sleeve 82 and engaging a retainer clip 96 attached to the ejector shaft 92 on its outer end as best shown in FIG. 2. A handle 98 is provided on the outer end of the ejector shaft 92 with the inner end of the ejector shaft including a guide slot 100 and a latch pin clearance slot 102.

A latch 104 is mounted for pivotal movement on a pivot pin 106 mounted on the mandrel sleeve 82 and extending diametrically across the internal opening therein. Latch 104 includes a latch surface 108 engageable with an annular rim surface 110 of a spool 112. Spring means 113 biases the latch into the position illustrated in FIG. 2. Additionally, a camming surface 114 on the forward end of the ejector shaft 92 is engageable with a canted surface 116 on latch 104 so that movement of the ejector shaft 92 to the right as viewed in FIG. 2 causes surface 114 to exert a reactive force on surface 116 to pivot the latch 104 downwardly against the bias of spring 113 so as to move the latching surface 108 out of contact with the rim surface 110 to permit removal of the spool 112 in an obvious manner. Spool 112 can simply be moved onto mandrel sleeve 82 by axial movement to the right in FIG. 2 which movement depresses the latch and then permits it to snap into locking position as shown in FIG. 2. Drive pin 90 extends into an opening 113 in the end of the spool to ensure rotation of the spool.

It should be understood that the preferred embodiment can be used for supporting a wide variety of spools, sleeves or the like depending upon the nature of the environment in which the winding apparatus is to be used. All that is necessary for effecting the changeover from one type of mandrel to another is to remove the three machine screws 81 connecting the coupling disc 80 to the driven carrier block 66. Upon removal of the coupling disc 80, etc., the device is then ready to receive another type of mandrel.

Figure 1:
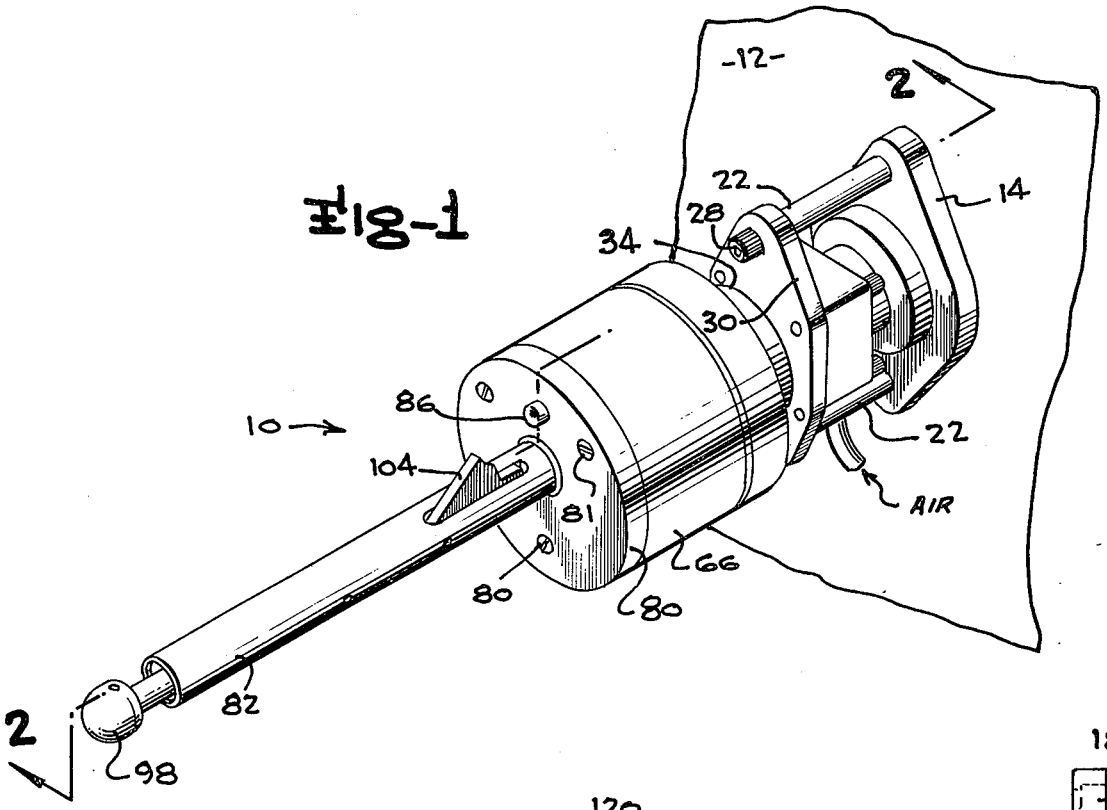
FIG. 1 is a perspective view of a first embodiment of the invention.
Figure 5:
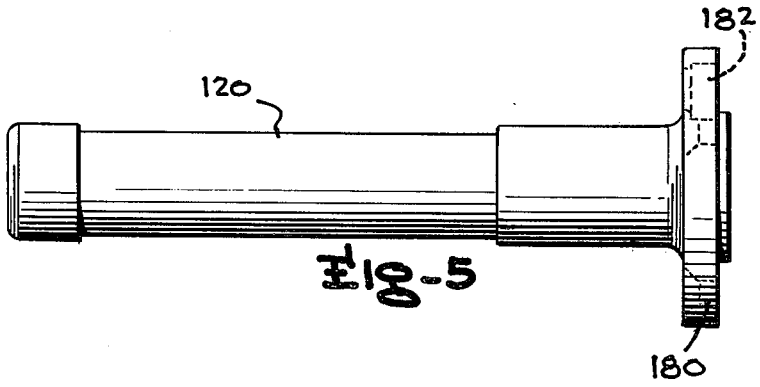
FIG. 5 is a side elevation view of a dye tube mandrel mountable with either embodiment.
Figure 7:
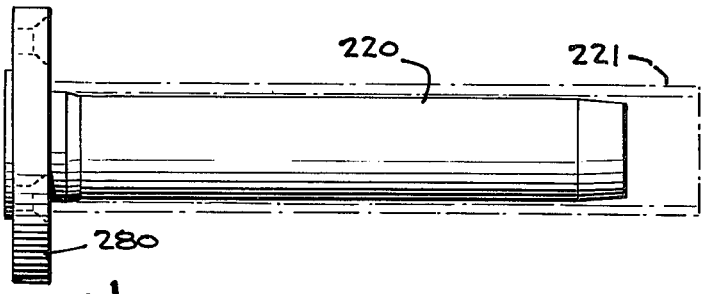
FIG. 7 is a side elevation view of a cardboard tube mandrel usable with either embodiment.
Figure 6:
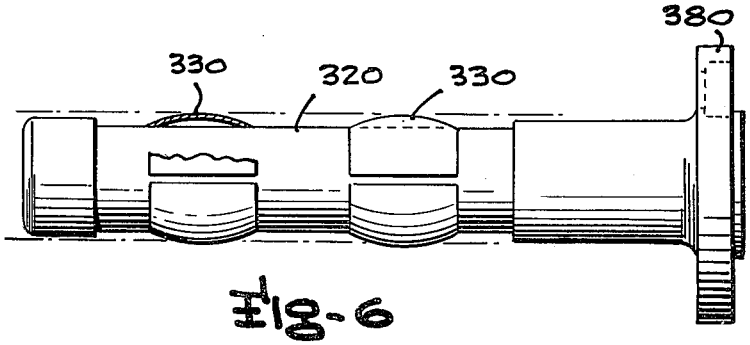
FIG. 6 is a side elevation view of a dye tube mandrel usable with either embodiment.

FIGS. 5 through 7 illustrate different types of mandrels which can be mounted on the driven carrier box 66. For example, FIG. 5 illustrates a simple dye tube mandrel 120 having a coupling disc 180 on one end which is identical to coupling disc 80 so as to be easily connectable to the driven carrier block 66.

In like manner, FIG. 7 illustrates a cardboard tube mandrel 220 having a coupling disc 280 on one end. Cardboard tube mandrel 220 is dimensioned to easily receive a cardboard tube 221 illustrated in phantom outline in FIG. 7. It should be observed that coupling disc 280 is basically identical to the coupling disc 80 with the exception of the fact that it does not include an opening for receiving drive pin 86 since a drive pin is not necessary for a cardboard tube such as tube 21. However, the coupling disc 280 can be connected to the carrier block 66 in the same manner as the previously discussed coupling discs.

FIG. 6 illustrates a dye tube mandrel 320 basically identical to mandrel 120 but including outwardly bowed dye spring tube retaining spring members 330 for engaging the inner surface of a dye tube. A carrier disc 380 on the end of the mandrel is identical to the carrier disc 180.

In operation, drive shaft 20 is driven by conventional means such as that shown in U.S. Pat. No. 4,157,793 with rotation of the drive disc 56 consequently being effected through key 60. Pressurized air from source VP is supplied through hose 50 to urge the piston 44 to the left into contact with the bearing means 54 so as to consequently urge drive disc 56 into friction engaging driving relationship with the end surface 67 of the driven carrier block 66 so that drive pin 86 effects rotation of the spool 112. The maximum torque applicable to the spool 112 will obviously vary in accordance with the air pressure provided to hose 50. It is consequently easy to adjust the maximum torque and consequent tension on the material being wound by simply adjusting the air pressure with monitoring of the pressure being effected automatically if desired. When the spool 112 is full, shaft 20 is stopped and handle 98 is moved to the right to cause latch 104 to be rotated in a clockwise direction to clear latching surface 108 from the surface 110 of the spool to permit the removal of the spool. A replacement spool is then easily slipped into position. If it is desired to use a different type of winding receiving means, such as a cardboard tube, the three machine screws 81 are removed and the associated coupling disc 80 etc. is decoupled from the driven mandrel carrier block 66. A new winding material receiving mandrel such as those illustrated in FIGS. 5, 6, or 7, is then easily repositioned on the driven carrier block 66 and held in position by the operation of the three machine screws 81 in an obvious manner.

Figure 4:
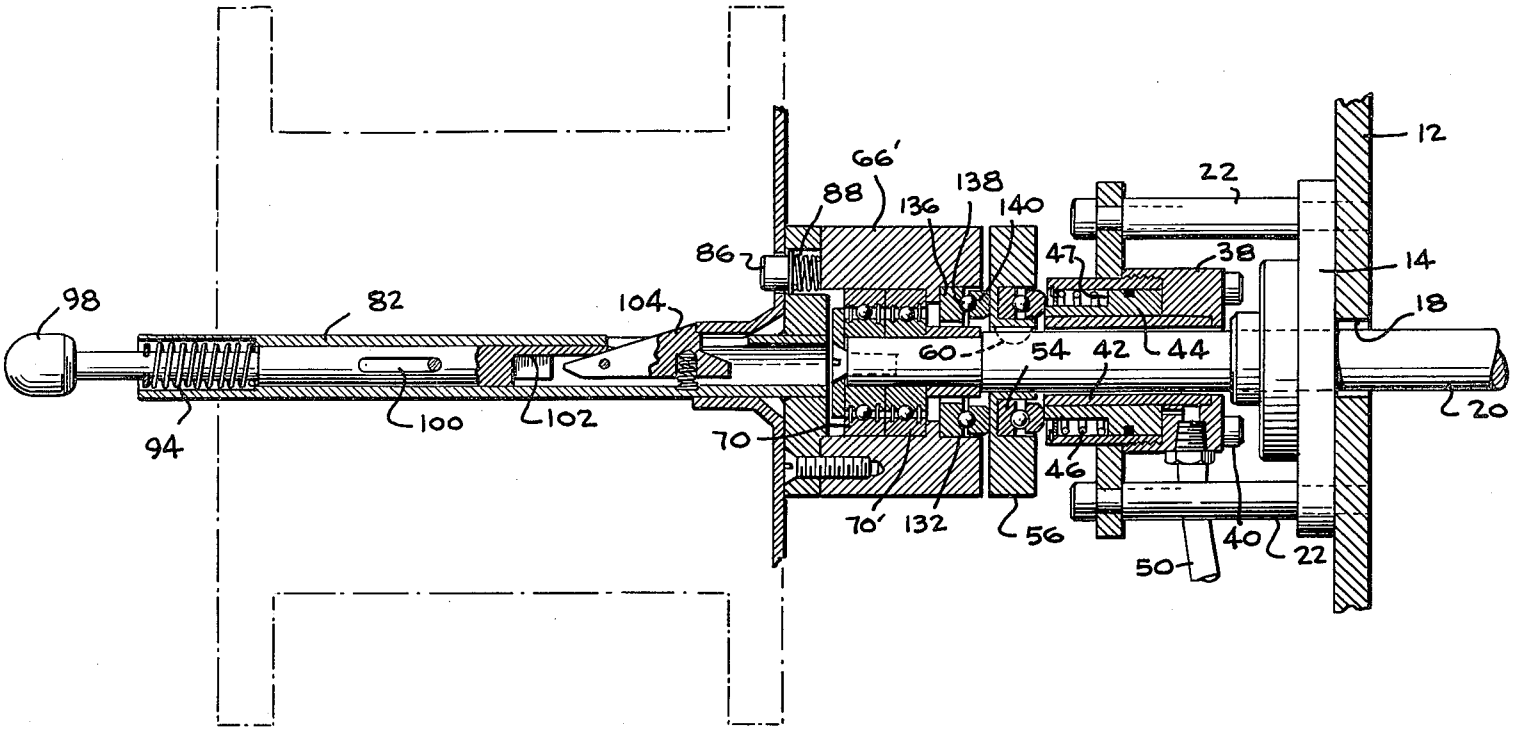
FIG. 4 is a sectional view similar to FIG. 2 but illustrating a second embodiment.

FIG. 4 illustrates a second embodiment of the invention in which the friction material 64 is eliminated and the drive torque to the drive pin 86 is provided solely by the rotational and other internal friction of a conventional thrust bearing 132 to effect an extremely smooth conveyance of torque to the spool. More specifically, the embodiment of FIG. 4 employs a modified driven carrier block 66' having rotary thrust bearing assembly 132 in its end facing the drive disc. The bearing assembly 132 includes an inner ring 136, a series of balls 138, and an outer ring 140 along with an internal retainer element which is not shown.

Additionally, the modified driven carrier block 66' is provided with a second supporting rotary bearing assembly 70'. In all other respects, the embodiment of FIG. 4 is identical to the embodiment of FIG. 2 and the corresponding parts consequently have the same reference numerals. Bearings 70' and bearings 70 cooperate to provide stable rotary support for the modified driven carrier block 66' in an obvious manner.

In operation, the embodiment of FIG. 4 operates with rotation of shaft 20 being conveyed to the drive disc 56 through key 60. Pressurized air provided through hose 50 urges the annular piston 44 to the left to consequently urge the drive disc 56 to the left against the rotary thrust bearing assembly 132. The thrust bearing assembly 132 has a small amount of internal rolling friction and sliding friction inherent to all ball bearing assemblies. The bearing assembly 132 is conventional and rotation of the outer ring 140 caused by frictional engagement with the drive disc 56 creates a certain amount of driving torque to the inner ring 136. The reason for the foregoing is due to the fact that bearing components, although made of hardened steel, are elastic bodies and when placed under load consequently deform a small amount. This fact creates the friction inherent in all rolling bodies. In essence, the deformation of the balls increases the surface pressure forwardly of the rolling action to provide a small amount of resistance to the rolling action which creates a reactive force resultant in the drive force applied to the inner ring 136 and carrier block 66'. Increasing the pressure applied by the annular piston 44 results in an increase in the deformation of the ball members so as to increase the friction forces and drive torque. Since only a small amount of torque is required, the system has been found to provide adequate winding torque which can be minutely adjusted by varying the air pressure on the annular piston 44. The adjustment has also been found to be much more smoothly effective than is the case with the first embodiment. In operation, the material to be wound is fed at a constant speed and the particular bearing employed for providing the driving torque can be selected to provide optimum results for the particular material being wound.

Numerous modifications of the disclosed embodiments will undoubtedly occur to those of skill in the art. However, it should be understood that the spirit and scope of the invention is to be limited solely by the appended claims.

We claim:

1. A winding system including:

frame means;

power driven shaft means mounted on said frame means;

a work fluid source for providing work fluid at a selected variable pressure;

a mandrel carrier block mounted for rotation;

mandrel means mounted on said mandrel carrier block for rotation therewith and including wound material support means for receiving material being wound;

work fluid controlled drive coupling means connected to said work fluid source for providing a selectively determined variable maximum drive torque to the carrier block from the power driven shaft means in accordance with the pressure of work fluid from said work fluid source; and wherein said mandrel means comprises;

a coupling disc removably connected to a side of said driven mandrel carrier block for coaxial rotation therewith;

a hollow mandrel sleeve extending outwardly in cantilever manner with respect to said coupling disc;

pivotal latch means mounted to extend outwardly of said mandrel sleeve for engaging a latch surface of spool means axially positionable over said mandrel sleeve;

ejector shaft means mounted in said mandrel sleeve for axial reciprocation between an outer latch portion and an inner latch release position in which a portion of said ejector shaft engages said latch member to pivot said latch member downwardly out of latching position to permit the removal of a spool from said mandrel sleeve; and manually operable handle means on an outer end of said ejector shaft for axially moving said ejector shaft.

2. A winding system including:

frame means;

power driven shaft means mounted on said frame means;

a work fluid source for providing work fluid at a selected variable pressure;

a mandrel carrier block mounted for rotation;

mandrel means mounted on said mandrel carrier block for rotation therewith and including wound material support means for receiving material being wound;

work fluid controlled drive coupling means connected to said work fluid source for providing a selectively determined variable maximum drive torque to the carrier block from the power driven shaft means in accordance with the pressure of work fluid from said work fluid source; and wherein said mandrel means comprises:

a coupling disc fixedly connected to a side of said driven mandrel carrier block for coaxial rotation therewith;

a hollow mandrel sleeve extending outwardly in cantilever manner with respect to said coupling disc;

pivotal latch means mounted to extend outwardly of said mandrel sleeve to a latching position for engaging a latch surface of spool means axially positionable over said mandrel sleeve;

spring means for urging said pivotal latch means toward its latching position;

ejector shaft means mounted in said mandrel sleeve for axial reciprocation between an outer latch position and an inner latch release position in which a portion of said ejector shaft engages said latch member to pivot said latch member downwardly out of latching position to permit the removal of a spool from said mandrel sleeve; and a handle on an outer end of said ejector shaft for enabling movement of the ejector shaft.

3. A winding system including:

frame means;

power driven shaft means mounted on said frame means;

a work fluid source for providing work fluid at a selected variable pressure;

a mandrel carrier block mounted for rotation;

mandrel means mounted on said mandrel carrier block for rotation therewith and including wound material support means for receiving material being wound;

work fluid controlled drive coupling means connected to said work fluid source for providing a selectively determined variable maximum drive torque to the carrier block from the power driven shaft means in accordance with the pressure of work fluid from said work fluid source; and wherein said work fluid control drive coupling means includes:

a rotary drive disc mounted on said driven shaft for axial movement with respect to said driven shaft and having first and second sides perpendicular to the axis of said driven shaft;

key and slot drive connection means between said driven shaft and said rotary drive disc for imparting rotary motion of said driven shaft to said rotary drive disc while permitting axial reciprocation of said rotary drive disc with respect to said driven shaft;

rotary thrust bearing means mounted on said carrier block in facing relation to said first side of said rotary drive disc for making driving contact with said rotary drive disc to effect driving rotation thereof;

annular piston and cylinder means fixedly positioned coaxially with respect to said power driven shaft and having an annular piston rod outer end in facing relationship with respect to said second side of said rotary drive disc;

rotary thrust bearing means mounted on said second side of said rotary drive disc in facing relation to and in contact with the end of said annular piston rod whereby movement of said annular piston rod toward said rotary drive disc effects movement of the rotary drive disc toward the driven mandrel carrier block with a force proportional to the pressure of working fluid in said annular cylinder so as to adjust the maximum amount of torque imparted to said driven mandrel carrier block by said drive disc; and compression spring means for urging said annular piston away from said rotary thrust bearing means;

and wherein said mandrel means comprises:

a coupling disc removably connected to a side of said driven mandrel carrier block for coaxial rotation therewith;

a hollow mandrel sleeve extending outwardly in cantilever manner with respect to said coupling disc;

pivotal latch means mounted to extend outwardly of said mandrel sleeve for engaging a latch surface of spool means axially positionable over said mandrel sleeve for holding such spool in driving position;

a spring urged drive pin mounted on said coupling disc to extend into a mating opening on one end of spool means in said driving position;

ejector shaft means mounted in said mandrel sleeve for axial reciprocation between an outer latch postiion and an inner latch release position in which a portion of said ejector shaft engages a surface on said latch member to pivot said latch member downwardly out of latching position to permit the removal of a spool from said mandrel sleeve;

spring means for urging said ejector shaft means toward its outer latch position; and manually operable handle means on an outer end of said ejector shaft for permitting manual movement of said ejector shaft toward its latch release position.

* * * * *